US011384757B2

(12) United States Patent
McCrossen et al.

(10) Patent No.: US 11,384,757 B2
(45) Date of Patent: Jul. 12, 2022

(54) MODULAR PUMP AND PUMPING SYSTEM INCLUDING SAME

(71) Applicant: Liberty Pumps, Inc., Bergen, NY (US)

(72) Inventors: Timothy D. McCrossen, Rochester, NY (US); Clement A. Pin, III, Rochester, NY (US); John Biegas, Batavia, NY (US)

(73) Assignee: Liberty Pumps, Inc., Bergen, NY (US)

( * ) Notice: Subject to any disclaimer, the term of this patent is extended or adjusted under 35 U.S.C. 154(b) by 0 days.

(21) Appl. No.: 16/942,010

(22) Filed: Jul. 29, 2020

(65) Prior Publication Data

US 2022/0034313 A1 Feb. 3, 2022

(51) Int. Cl.

| | |
|---|---|
| ***F04B 53/22*** | (2006.01) |
| ***F04B 53/16*** | (2006.01) |
| ***F04D 13/06*** | (2006.01) |
| ***F04D 29/60*** | (2006.01) |
| ***F04D 29/62*** | (2006.01) |
| ***F04B 23/02*** | (2006.01) |
| ***F04D 29/08*** | (2006.01) |
| ***F04B 49/025*** | (2006.01) |

(52) U.S. Cl.

CPC ..... *F04B 53/22* (2013.01); *F04B 23/021* (2013.01); *F04B 53/16* (2013.01); *F04D 13/0613* (2013.01); *F04D 13/0626* (2013.01); *F04D 29/606* (2013.01); *F04D 29/62* (2013.01); *F04B 49/025* (2013.01); *F04D 29/086* (2013.01)

(58) Field of Classification Search

CPC ..... F04B 53/22; F04B 23/021; F04B 53/16; F04B 49/025; F04D 29/607; F04D 29/606; F04D 29/62; F04D 29/60; F04D 13/0626; F04D 13/0613; F04D 29/08; F04D 29/086; F04D 13/0606; F04D 13/06; Y10T 403/7005; Y10T 403/7007; Y10T 403/7015; Y10T 137/87772; F16K 11/05; F16K 11/0655; F16K 11/07

See application file for complete search history.

(56) References Cited

U.S. PATENT DOCUMENTS 3,316,845 A * 5/1967 Schumann ..... F04D 13/086 417/40
4,532,672 A * 8/1985 Anderson ..... E05F 5/06 16/86 A
5,044,883 A * 9/1991 Neueder ..... F04D 29/628 415/214.1

(Continued)

*Primary Examiner* — Kenneth J Hansen
(74) *Attorney, Agent, or Firm* — John M. Hammond; Patent Innovations LLC

(57) ABSTRACT

A pump cartridge comprising an external housing including a lateral wall, a first fin extending from a first side of the lateral wall, and a second fin extending from a second side of the lateral wall. The second side of the lateral wall may be opposite the first side of the lateral wall, such that the fins are on opposite sides of the lateral wall. The pump cartridge may be part of a pumping system further comprised of a chassis comprising a pump basin including an interior side wall, a first tab extending inwardly from the interior side wall, and a second tab extending inwardly from the interior side wall and opposed to the first tab. The first fin of the cartridge is reversibly engageable with the first tab of the chassis and the second fin of the cartridge is reversibly engageable with the second tab of the chassis.

21 Claims, 8 Drawing Sheets

(56) References Cited

U.S. PATENT DOCUMENTS

| | | | | |
|---|---|---|---|---|
| 5,232,341 | A * | 8/1993 | Shier | F04D 29/628 384/537 |
| 5,538,406 | A * | 7/1996 | Siegal | F04D 29/628 417/361 |
| 7,748,957 | B2 * | 7/2010 | Schopperle | B01D 35/26 415/214.1 |
| 2003/0091440 | A1 * | 5/2003 | Patel | F04D 29/426 417/40 |
| 2011/0150676 | A1 * | 6/2011 | Buzit | F04D 9/008 417/410.1 |

* cited by examiner

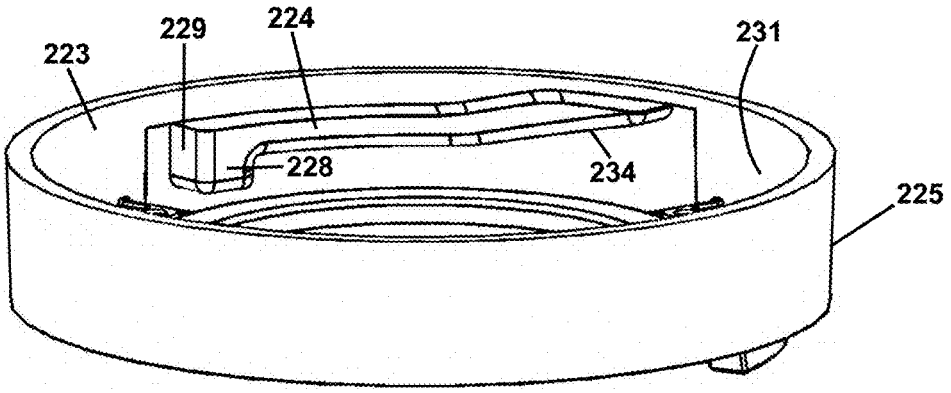
FIG. 10
FIG. 11
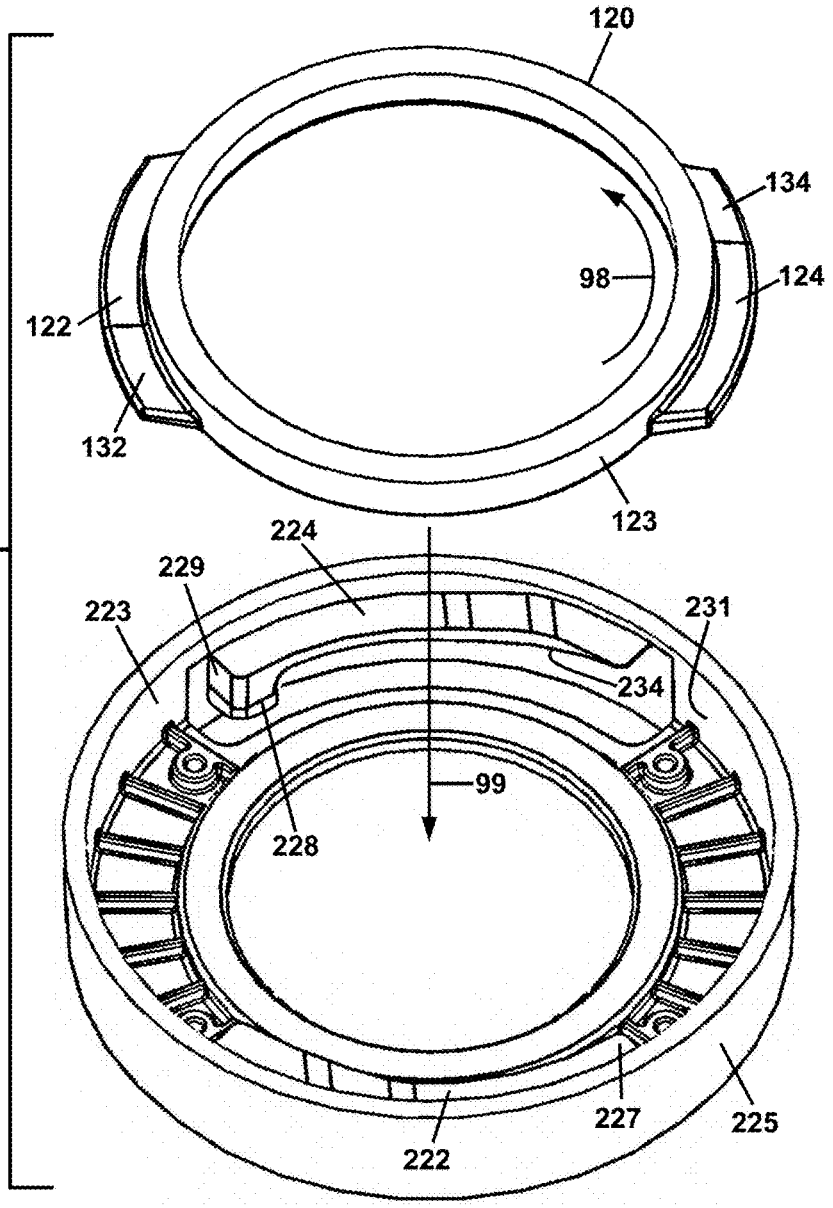

MODULAR PUMP AND PUMPING SYSTEM INCLUDING SAME

BACKGROUND

Technical Field

Fluid pumps, and in particular, a pump that is easily removed from its working environment and replaced in its working environment.

Description of Related Art

Fluid pumps, for pumping of gases and liquids, are used in a broad range of applications. The operating environment of a fluid pump may be hostile, i.e., an environment that causes wear and degradation to the pump through exposure to ambient pressures, temperatures, and/or substances present. Additionally, a fluid pump may undergo degradation due to adverse effects of the fluid that is being transported by the pump. For example, the fluid to be transported may be a liquid that contains highly corrosive constituents, or abrasive constituents, such as sand. Other solids that are present in a liquid to be pumped may interfere with a liquid motive device of the pump, such as an impeller. Such solids may cause jamming or entanglement of the motive device, causing the pump to cease operation or have a reduced output.

When a pump undergoes damage due to these adverse conditions or materials, it is often necessary to remove the pump from service in its working environment, and remotely perform repairs on the pump, or install another pump in its place. In most circumstances, the pump delivers fluid out of an outlet port, which is connected to an outlet conduit, also referred to as a tube or tubing, or a pipe or piping. Additionally, the pump takes in fluid through an inlet port, which may be connected to an inlet conduit, which may be in fluid communication with a fluid reservoir. The connection of an outlet port of the pump to an outlet conduit is typically achieved by the joining of fittings, such as threaded pipe fittings, compression fittings, quick connects, and the like. The connection of an inlet port of the pump to an inlet conduit may be done in a similar manner.

When it becomes necessary to remove the fluid pump from its working environment, it is necessary to disconnect the connection fittings at the pump outlet and the pump inlet. This can be a tedious and difficult task, particularly because pumps are often installed in locations that are difficult to access and utilize tools. Additionally, the ambient conditions in the working environment may be dangerous and/or the substances being pumped may be flammable, explosive, toxic, and otherwise hazardous to personnel.

Accordingly, there is a need for a fluid pump that is easily installed and removed from its working environment.

SUMMARY

According to the present disclosure, a pump is provided in the form of a pump cartridge, which is easily installed and removed from its working environment. The pump cartridge is comprised of an external housing including a lateral wall, a first fin extending outwardly from a first side of the lateral wall, and a second fin extending outwardly from a second side of the lateral wall. The second side of the lateral wall may be opposed to the first side of the lateral wall, such that the fins are on substantially opposite sides of the lateral wall.

The first and second fins may extend outwardly from a distal region of the lateral wall. The lateral wall of the external housing may be cylindrical, with the first and second fins extending radially outwardly from a distal region of the lateral wall. The pump cartridge may be further comprised of a first cylindrical flange extending radially outwardly from the lateral wall and a second cylindrical flange extending radially outwardly from the lateral wall. The first and second cylindrical flanges may be proximate to each other, thereby defining a channel formed between them. A seal may be disposed in the channel.

The pump cartridge of the present disclosure may be a component of a pumping system. The pumping system may be further comprised of a chassis comprising a pump basin including an interior side wall, a first tab extending inwardly from the interior side wall, and a second tab extending inwardly from the interior side wall and opposed to the first tab. In such a pumping system, the first fin of the pump cartridge is reversibly engageable with the first tab of the chassis and the second fin of the pump cartridge is reversibly engageable with the second tab of the chassis. Additionally, the first fin of the pump cartridge may be reversibly engageable with the second tab of the chassis and the second fin of the pump cartridge may be reversibly engageable with the first tab of the chassis.

The first and second fins may extend outwardly from a distal region of the lateral wall of the pump cartridge, and the first and second tabs may extend inwardly from a distal region of the interior side wall of the chassis. In some instances, the lateral wall of the external housing of the pump cartridge may be cylindrical, with the first and second fins extending radially outwardly from the lateral wall. The interior side wall of the chassis may be cylindrical, with the first and second tabs extending inwardly from a distal region of the interior side wall of the chassis.

In instances where the pump cartridge is further comprised of a first cylindrical flange extending radially outwardly from the lateral wall and a second cylindrical flange extending radially outwardly from the lateral wall, and the first and second cylindrical flanges are proximate to each other, a seal disposed in the channel formed between the flanges is dimensioned to be in contiguous contact with the interior side wall of the chassis.

In an access position of the pump cartridge, the first fin of the pump cartridge is disengaged from the first tab of the chassis and the second fin of the pump cartridge is disengaged from the second tab of the chassis. In a first operating position of the pump cartridge, the first fin of the pump cartridge is engaged with the first tab of the chassis and the second fin of the pump cartridge is engaged with the second tab of the chassis. The first tab of the chassis may include a nub extending downwardly from an inward end of the first tab, and the second tab of the chassis may include a nub extending downwardly from an inward end of the second tab. In the first operating position of the pump cartridge, the first fin of the pump cartridge is in contact with the nub of the first tab, and second fin of the pump cartridge is in contact with the nub of the second tab.

In a second operating position of the pump cartridge, the first fin of the pump cartridge is engaged with the second tab of the chassis and the second fin of the pump cartridge is engaged with the first tab of the chassis. The external housing of the pump cartridge is reversibly rotatable between the access position of the pump cartridge and the operating positions of the pump cartridge.

The pumping system may be further comprised of a volute cover joined to a bottom wall of the chassis, and an impeller joined to a rotatable shaft of a pump motor and contained within a volute formed by the volute cover and the bottom wall of the chassis. The chassis and pump cartridge may be disposed in an external basin. The pumping system may be further comprised of a cover removably joined to the external basin. The pumping system may be further comprised of a level switch assembly disposed in the external basin.

BRIEF DESCRIPTION OF THE DRAWINGS

The present disclosure will be provided with reference to the following drawings, in which like numerals refer to like elements, and in which:

FIG. 10 is an oblique perspective view of the distal end of a pump basin of a chassis of the pumping system of FIG. 1, shown in cross-section at a plane perpendicular to the side wall of the pump basin, the plane located at line 10-10 of FIG. 3; and FIG. 11 is an exploded perspective view of the distal end of an external housing of a pump cartridge and the distal end of a pump basin of a chassis of a pumping system of FIG. 1, with both pieces shown in cross-section at a plane perpendicular to the side wall of the pump basin.

Figure 1:
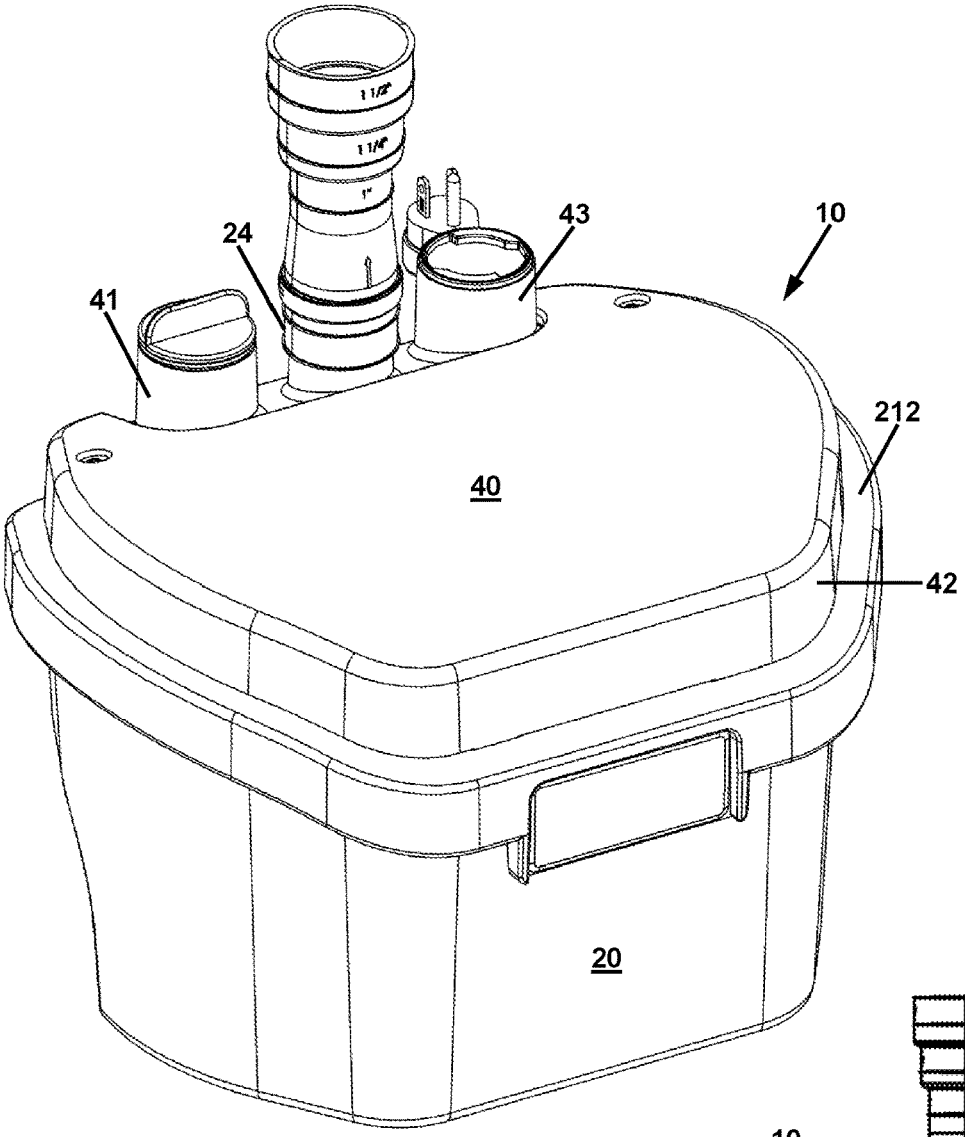
FIG. 1 is a perspective view of a pumping system containing a pump cartridge of the present disclosure.
Figure 2:
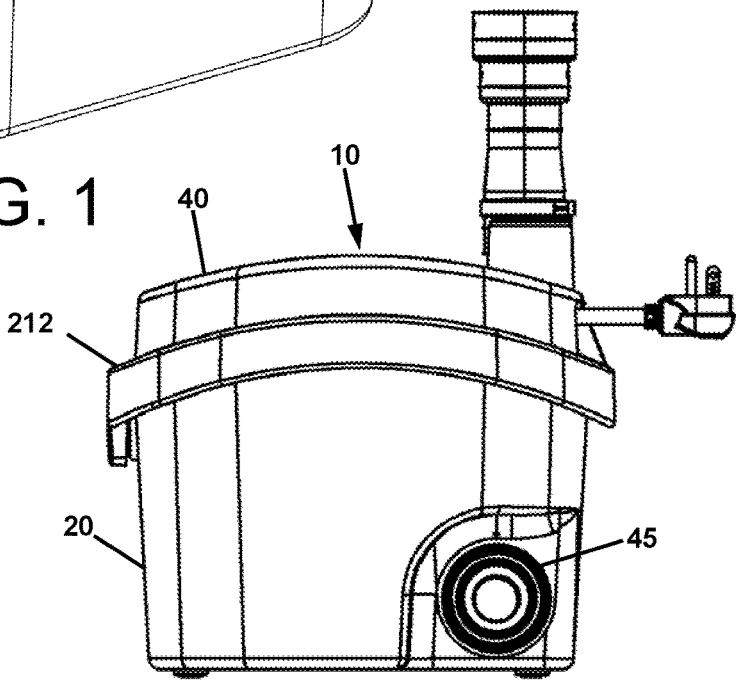
FIG. 2 is a side elevation view of the pumping system of FIG. 1.

The present invention will be described in connection with certain preferred embodiments. However, it is to be understood that there is no intent to limit the invention to the embodiments described. On the contrary, the intent is to cover all alternatives, modifications, and equivalents as may be included within the spirit and scope of the invention as defined by the appended claims.

DETAILED DESCRIPTION

For a general understanding of the present disclosure, reference is made to the drawings. In the drawings, like reference numerals have been used throughout to designate identical elements. The drawings are to be considered exemplary, and are for purposes of illustration only. The dimensions, positions, order and relative sizes reflected in the drawings attached hereto may vary.

In the following disclosure, the present invention is described in the context of its use as a pump for transporting liquids. However, it is not to be construed as being limited only to use as a liquid pump. The invention is adaptable to any use in which it is desirable to pump fluids, including gases, and multiphase mixtures of liquids, solids, and/or gases. Additionally, the description may identify certain components with the adjectives "top," "upper," "bottom," "lower," "left," "right," etc. These adjectives are provided in the context of use of the pump and pump cartridge in a basin, and in the context of the orientation of the drawings. The description is not to be construed as limiting the pump and pumping system to use in a particular spatial orientation. The instant pump and pumping system may be used in orientations and environments other than those shown and described herein.

It is also to be understood that any connection references used herein (e.g., attached, coupled, connected, and joined) are to be construed broadly and may include intermediate members between a collection of elements and relative movement between elements unless otherwise indicated. As such, connection references do not necessarily imply that two elements are directly connected and in fixed relation to each other.

When used, the terms "preferred" and "preferably" refer to embodiments of the invention that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the present disclosure.

The terms "about" and "substantially" are used herein with respect to measurable values and ranges due to expected variations known to those skilled in the art (e.g., limitations and variabilities in measurements).

In accordance with the present disclosure, the need for a fluid pump that is easily installed and removed from its working environment is satisfied by a pump and by pumping systems disclosed herein.

FIGS. 1-5 depict various views of a pumping system of the present disclosure. The pumping system 10 is comprised of a pump 100 and a chassis 200. The pumping system 10 may further include an external basin 20, a cover 40, and a level switch assembly 60. Spatial arrangements of the pump cartridge 100, chassis 200, external basin 20, cover 40, and level switch assembly 60 other than shown in FIGS. 1-5 may be suitable. The pump cartridge 100, which is easily installed and removed from its working environment further includes fluid moving components such as a pump motor and a rotating impeller, as will be explained subsequently.

The pump cartridge 100 is easily installed and removed from the pumping system 10 by virtue of features provided in the pump cartridge 100 and chassis 200. The pump cartridge is easily moved from an operational position to an access position, from which the pump cartridge 100 may be removed from the pumping system 10. In like manner, but in reverse order, the pump cartridge 100 may be moved from an external position into the access position, and then easily moved to the operational position.

Figure 3:
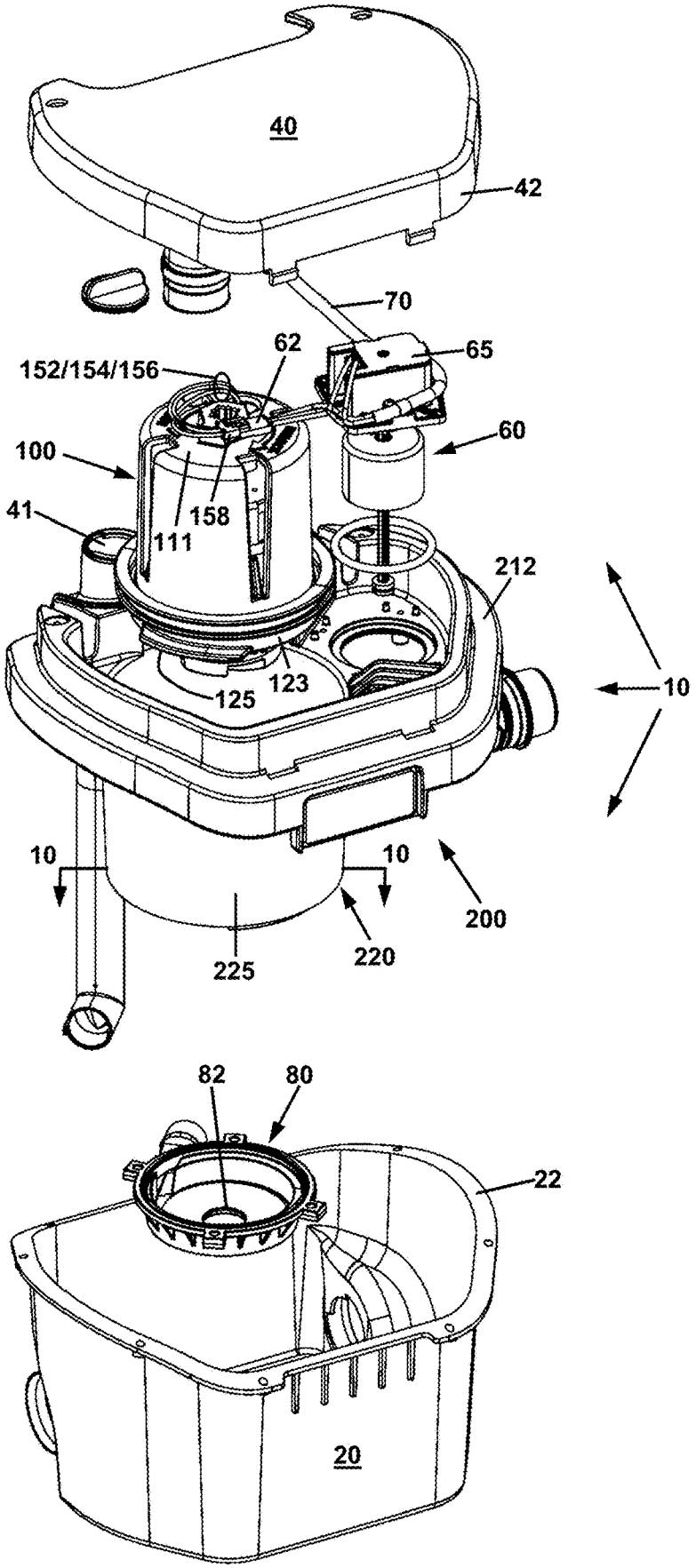
FIG. 3 is an exploded perspective view of the pumping system of FIG. 1.
Figure 4:
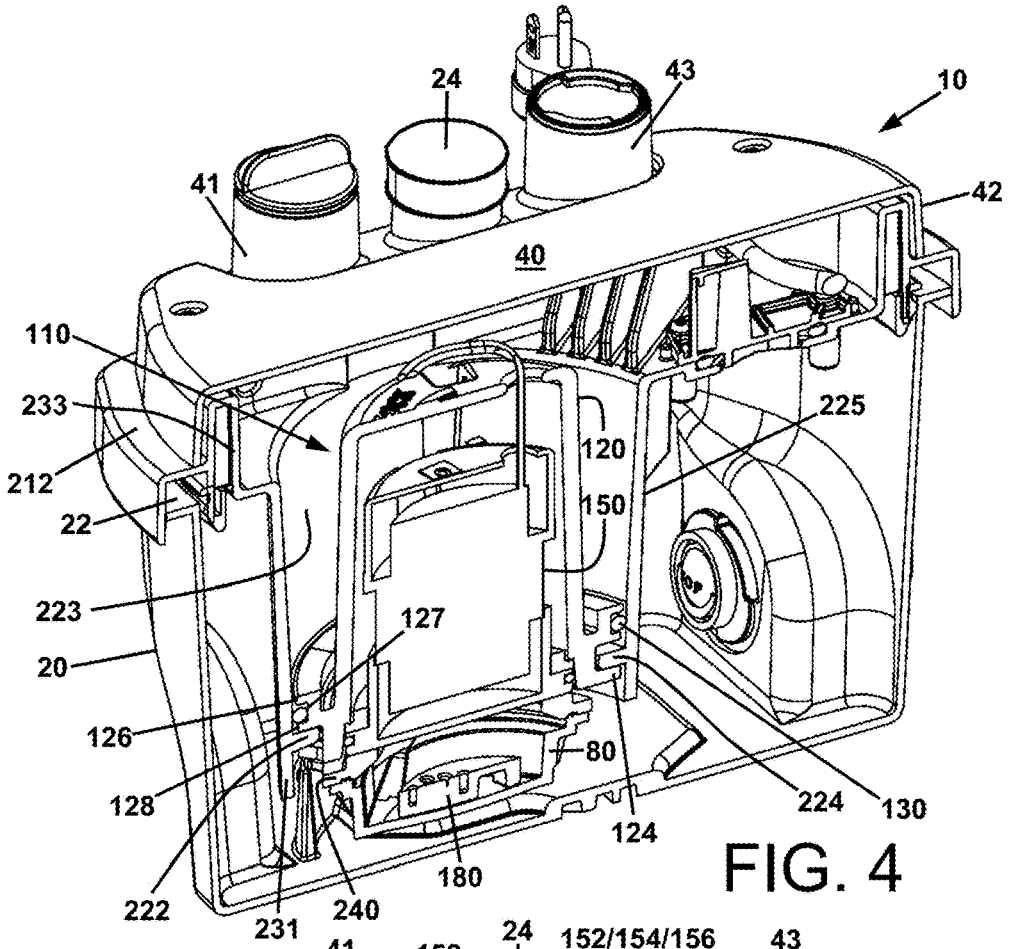
FIG. 4 is a cross-sectional perspective view of the pumping system of FIG. 1.
Figure 5:
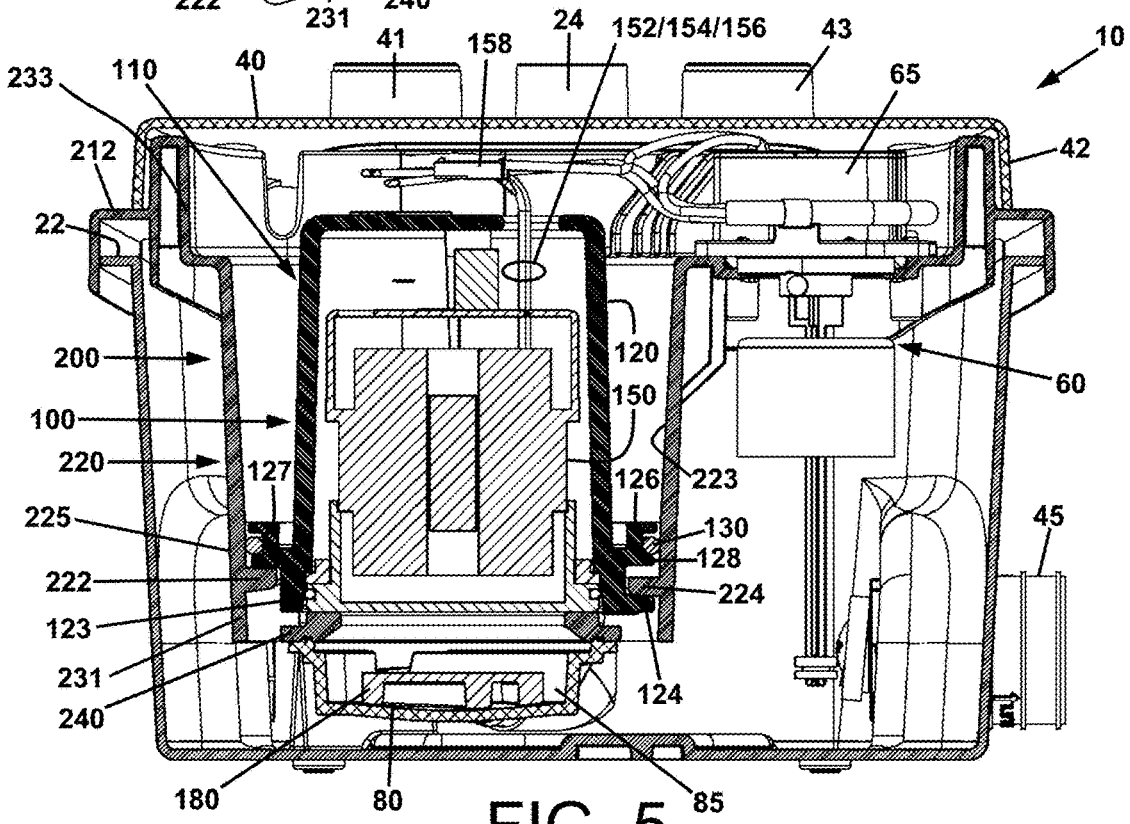
FIG. 5 is a cross-sectional front elevation view of the pumping system of FIG. 1.
Figure 6:
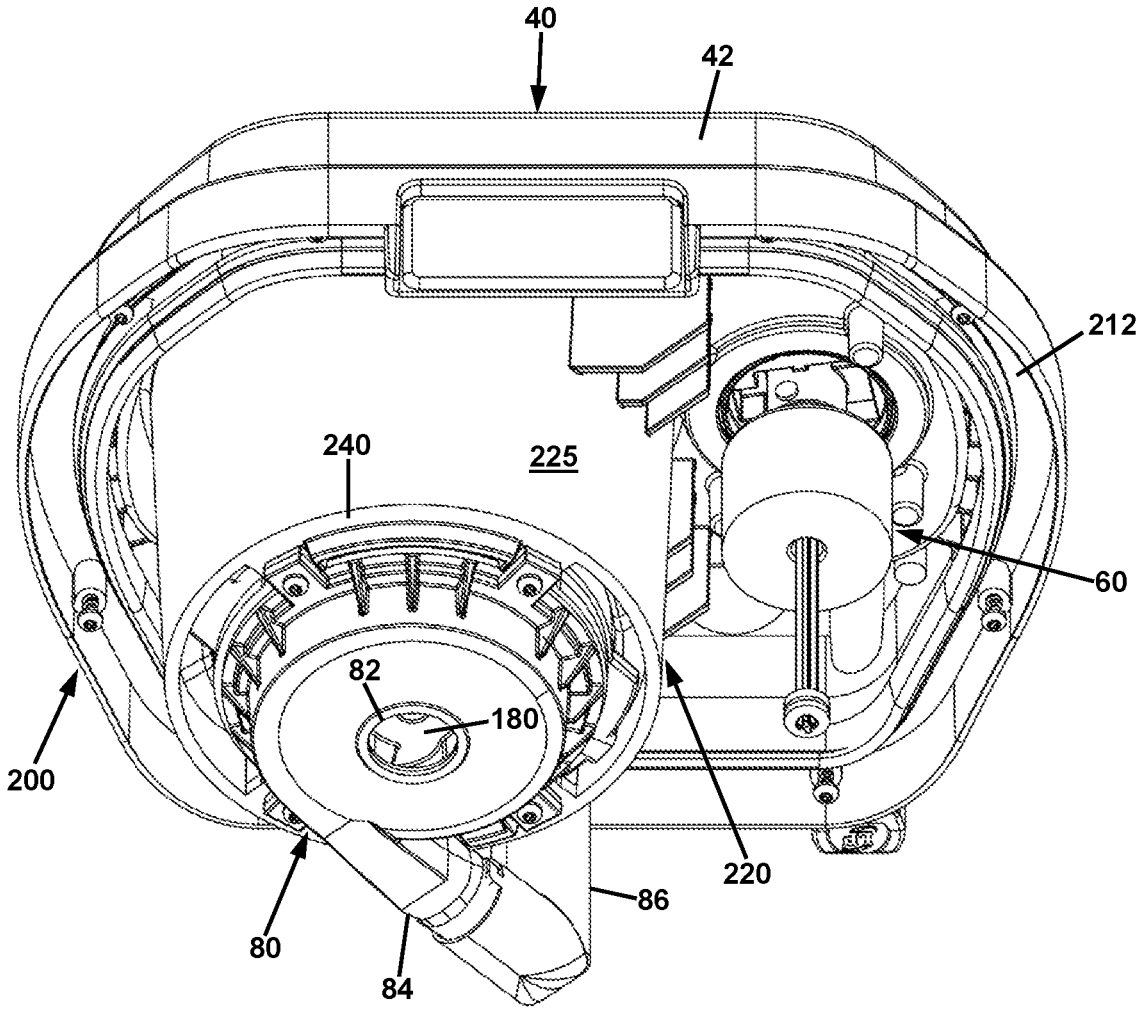
FIG. 6 is a lower perspective view of a top cover, chassis, and pump cartridge of the pumping system of FIG. 1.
Figure 7:
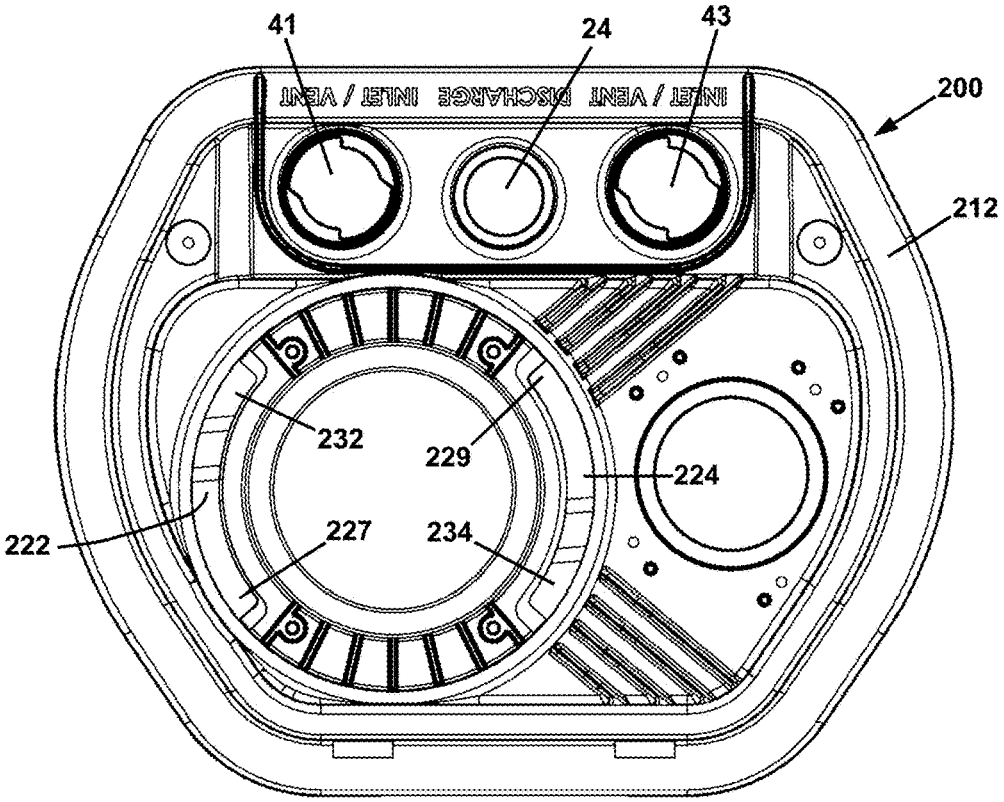
FIG. 7 is a top view of the chassis of the pumping system of FIG. 1.
Figure 8:
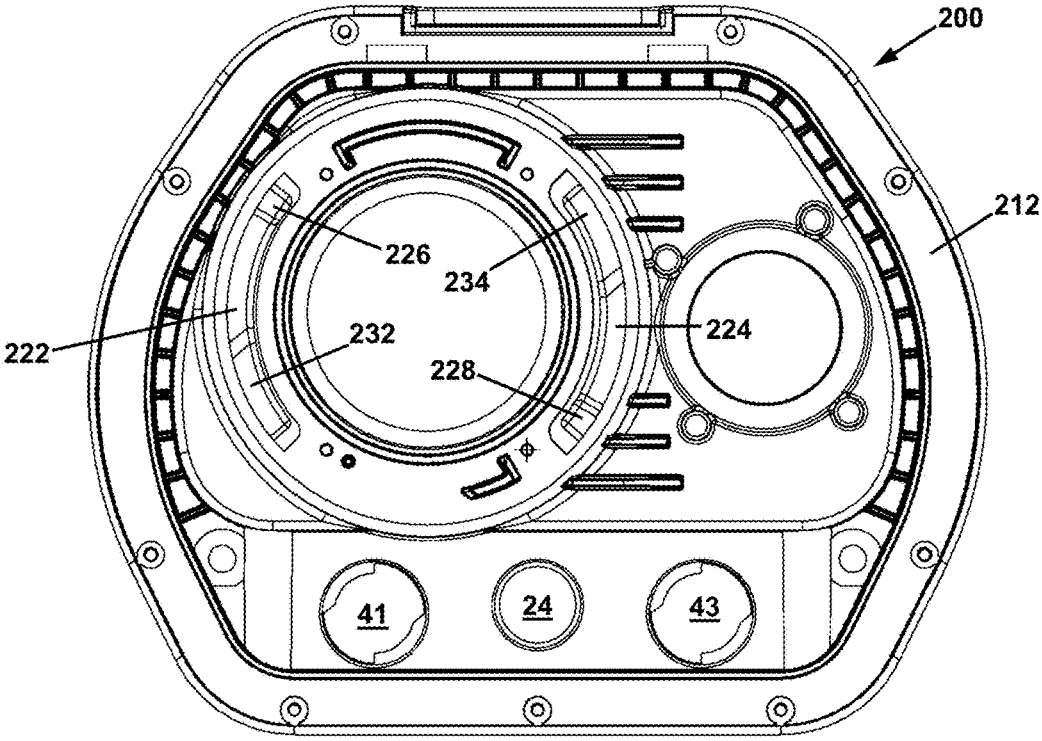
FIG. 8 is a bottom view of the chassis of the pumping system of FIG. 1.

This is best understood with reference to FIGS. 7-11, as well as FIGS. 3-5. In the exploded view of FIG. 3, the pump cartridge 100 is shown disengaged from the chassis 200, and in an external position relative to the external basin 20. In FIGS. 4 and 5, the pump cartridge 100 is shown engaged with the chassis 200, and in an operational position, ready to perform the pumping of a fluid (not shown).

The pump cartridge 100 is comprised of an external housing 110 comprised of a top wall 112 at a proximal (upper) end 111 of the cartridge 100, and a lateral wall 120. A first fin 122 extends outwardly from a first side of the lateral wall 120, and a second fin 124 extends outwardly from a second side of the lateral wall 120. The second side of the lateral wall 120 may be opposed to the first side of the lateral wall 120, such that the fins 122 and 124 are on substantially opposite sides of the lateral wall 120, i.e., on sides about 180 degrees apart.

The first and second fins 122 and 124 may extend outwardly from a distal region 123 of the lateral wall 120 that is proximate to the distal (lower) end 125 of the cartridge 100. In the pumping assembly 10 and the pump cartridge 100 installed therein as shown in FIGS. 3-5, first and second fins 122 and 124 may extend outwardly from a bottom region 123 of the lateral wall 120. The lateral wall 120 of the external housing 110 may be cylindrical, with the first and second fins 122 and 124 extending radially outwardly from the distal region 123 of the lateral wall 120.

The pump cartridge 100 may be further comprised of a first cylindrical flange 126 extending radially outwardly from the lateral wall 120 and a second cylindrical flange 128 extending radially outwardly from the lateral wall 120. The first and second cylindrical flanges 126 and 128 may be proximate to each other, thereby defining a channel 127 formed between them. A seal 130 may be disposed in the channel 127. The seal 130 may be an O-ring seal having a circular cross-sectional shape as shown for seal 130 in FIGS. 4, 5, and 9A. Alternatively, the seal 130 may have a square or rectangular cross-sectional shape. The seal 130 is made of a suitable compliant material, such as nitrile rubber, or another elastomeric material that is chemically resistant to the fluid that is being pumped.

The pumping system 10 is further comprised of a chassis 200. The chassis 200 serves as a fixture for the pumping system 10, holding the pump cartridge 100 in an operating position. The chassis 200 may also hold a level switch assembly 60. The chassis 200 may include a support flange 212 shaped to match a corresponding flange 22 on external basin 20, to which chassis 200 is joined when the pumping system 10 is assembled. The cover 40 has a downward perimeter flange 42 having a shape that corresponds to the shape of the support flange 212.

The chassis 200 is further comprised of a downwardly extending pump basin 220 having an interior side wall 223 including upper region 233 and lower region 231, and an exterior wall 225. A first tab 222 extends inwardly from the lower region 231 of the interior side wall 223, and a second tab 224 extends inwardly from the lower region 231 of the interior side wall 223 in a location opposed to the first tab 222. In the pumping system 10, the first fin 122 of the pump cartridge 100 is reversibly engageable with the first tab 222 of the chassis 200 and the second fin 124 of the pump cartridge 100 is reversibly engageable with the second tab 224 of the chassis 200, as will be explained subsequently in further detail. In some instances, the interior side wall 223 of the chassis 200 may be cylindrical, with the first and second tabs 222 and 224 extending inwardly from the lower or distal region 231 of the interior side wall 223 of the chassis 200. The first tab 222 of the chassis 200 may include a nub 226 extending downwardly from an inward end 227 of the first tab 222, and the second tab 224 of the chassis 200 may include a nub 228 extending downwardly from an inward end 229 of the second tab 224.

In instances where the pump cartridge 100 is further comprised of a first cylindrical flange 126 extending radially outwardly from the lateral wall 120 and a second cylindrical flange 128 extending radially outwardly from the lateral wall 120, and the first and second cylindrical flanges 126 and 128 are proximate to each other, a seal 130 that is disposed in the channel 127 formed between the flanges 126 and 128 is dimensioned to be in contiguous contact with the interior side wall 223 of the chassis 200. In that manner, a seal between the pump cartridge 100 and the chassis 200 is achieved, and fluid to be pumped by the system 10 is prevented from flowing into any open space in the pump basin 220 that is above the seal 130.

To install the pump cartridge 100 in the pumping system 10, the pump cartridge is moved to an access position. (The position is referred to as an "access position" because in this position, the pump cartridge 100 is not installed in the chassis 200, and instead is accessible, i.e., an operator can easily lift the pump cartridge 100 out of the pump basin 220 of the chassis 200, repair it, or replace it with another pump cartridge 100.) Referring to FIG. 11 in particular, in the access position, the pump cartridge 100 is positioned relative to the chassis 200 such that the first fin 122 of the pump cartridge 100 is disengaged from the first tab 222 of the chassis 200 and the second fin 124 of the pump cartridge 100 is disengaged from the second tab 224 of the chassis 200. In other words, the first and second fins 122 and 124 are aligned with respective gaps between the first and second tabs 222 and 224. The pump cartridge 100 is moved into the access position as indicated by arrow 99. In the access position, the first and second fins 122 and 124 are disposed in a plane that is slightly beneath a plane in which the first and second tabs 222 and 224 lie.

Figure 9A:
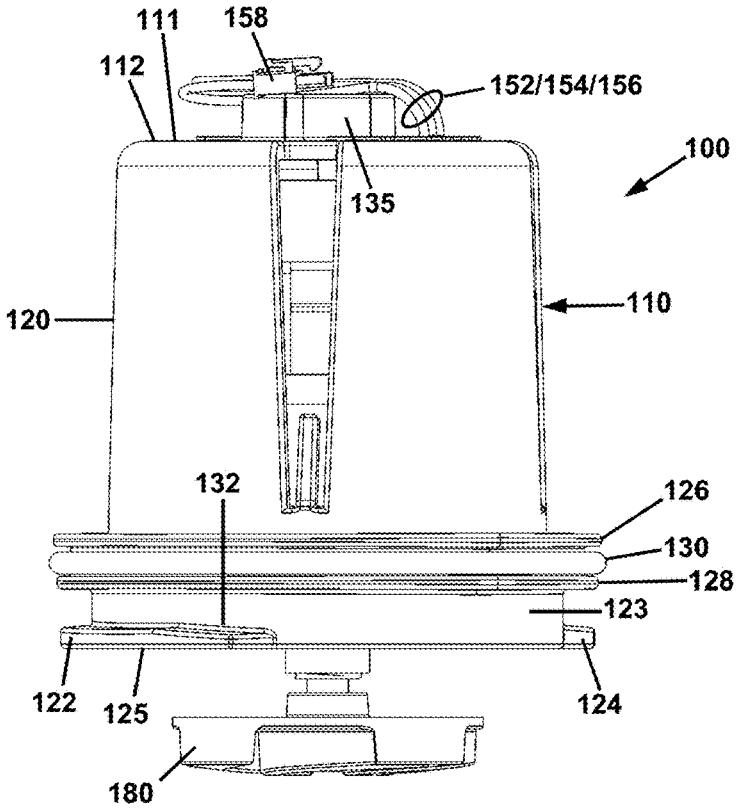
FIG. 9A is a side elevation view of the pump cartridge that is included in the pumping system of FIG. 1.
Figure 9B:
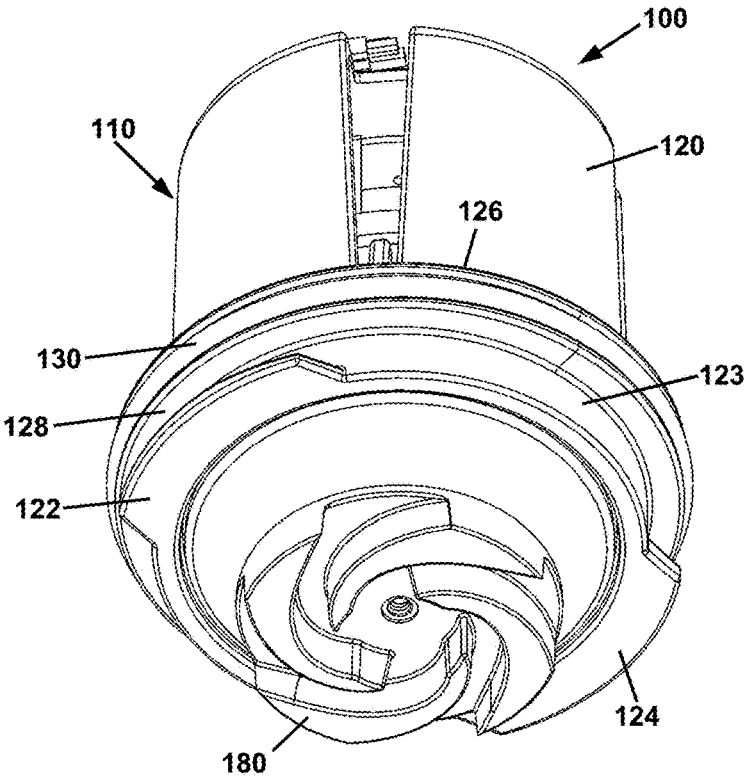
FIG. 9B is a lower perspective view of the pump cartridge of FIG. 9A.
Figure 9C:
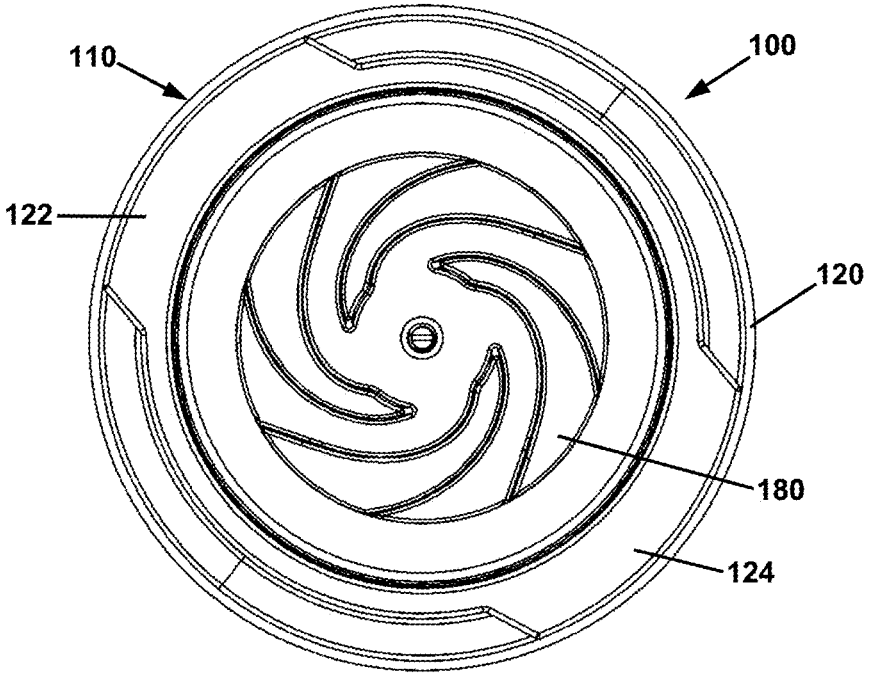
FIG. 9C is a bottom view of the pump cartridge of FIG. 9A.
Figure 9D:
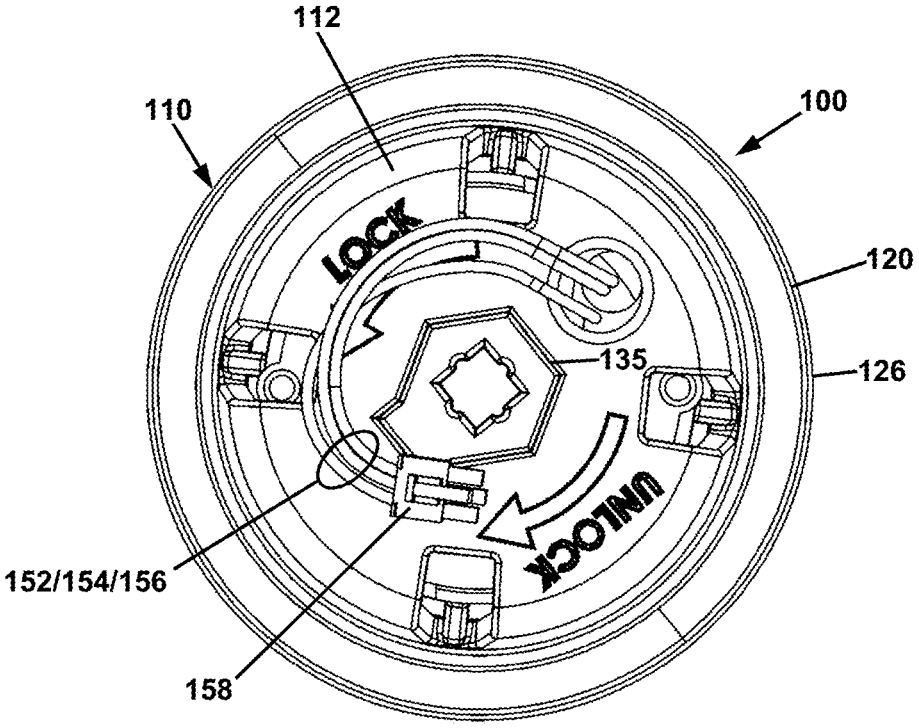
FIG. 9D is a top view of the pump cartridge of FIG. 9A.

Referring to FIGS. 7-11, and to FIGS. 10 and 11 in particular, to install the pump cartridge 100 in the operating position, the pump cartridge 100 is rotated as indicated by arrow 98 in FIG. 11, and as indicated by the "LOCK" arrow in FIG. 9D. With such rotation, the first fin 122 of the pump cartridge 100 is engaged with the first tab 222 of the chassis 200, and the second fin 124 of the pump cartridge 100 is engaged with the second tab 224 of the chassis 200. The first fin 122 may be provided with a tapered ramp section 132, and the first tab 222 may be provided with a tapered ramp section 232. In like manner, the second fin 124 may be provided with a tapered ramp section 134, and the second tab 224 may be provided with a tapered ramp section 234. In that manner, at the start of rotation, engagement of the respective fins 122 and 124 and tabs 222 and 224 are facilitated. The remaining sections of the fins 122 and 124 and tabs 222 and 224 may be dimensioned such that when the rotation to the operating position is completed, there is an interference fit between the respective pairs of the fins and tabs, thereby rigidly securing the pump cartridge 100 in the chassis 200 in the operating position. Additionally, when the pump cartridge 100 is in the operating position, the first fin 122 of the pump cartridge 100 may be in contact with the nub 226 provided at the end 227 of the first tab 222, and the second fin 124 of the pump cartridge 100 may be in contact with the nub 228 provided at the end 229 of the second tab 224. The nubs 226 and 228 act as stops to halt rotation of the pump cartridge 100, thereby ensuring that the pump cartridge 100 is fully engaged with the chassis 200 and in the operating position.

An engagement feature may be provided on the pump cartridge 100 for engagement of a tool that provides the torque for rotating the pump cartridge 100 into the operating position. Referring to FIG. 9D, the engagement feature 135 may have the form of a hex nut, and/or the engagement feature 135 may have a square recess which may receive the square drive of a common socket wrench. Alternatively, the engagement feature 135 may have a hexagonal recess for receiving a hex wrench.

In an alternative access position, the pump cartridge 100 may be rotated 180 degrees from the position shown in FIG.

11 and described above. This results in a second operating position of the pump cartridge 100, in which the first fin 122 of the pump cartridge 100 is engaged with the second tab 224 of the chassis 200 and the second fin 124 of the pump cartridge 100 is engaged with the first tab 222 of the chassis.

The external housing 120 of the pump cartridge 100 is reversibly rotatable between the access positions of the pump cartridge 100 and the operating positions of the pump cartridge 100. Accordingly, in removing the pump cartridge 100 from the pumping system 10, the above steps of installation of the pump cartridge 100 are reversed. In that manner, installation of the pump cartridge 100 and removal of the pump cartridge 100 from the pumping system 10 are very simple and rapid.

Referring to FIGS. 3-6, the pumping system 10 may be further comprised of a volute cover 80 joined to a bottom wall 240 of the chassis 200. Referring also to FIGS. 9A-9C, an impeller 180 is joined to a rotatable shaft (not shown) of the pump cartridge 100. The impeller 180 is contained within a volute 85 formed by the volute cover 80 and the bottom wall 240 of the chassis 200.

In operation of the pumping system 10, fluid (not shown) to be pumped is provided through an inlet conduit(s) (not shown), which may be connected to one or more of various inlet ports 41, 43, and/or 45. The fluid is contained within the open volume in the external basin 20 that is beneath the chassis 200 and pump cartridge 100. Electrical power to the pump is provided through the level switch assembly 60, which provides on/off control of the pump based on the level of the fluid within the external basin20. Electrical power applied to the pump motor 150 causes rotation of the impeller 180. Fluid in the external basin 20 is drawn into the volute 85 though an opening 82 in volute cover 80. The impeller 180 drives fluid through a pump outlet port 84 and through an outlet conduit 86. The fluid exits the pumping system 10 though an external basin outlet port 24.

Easy removal and replacement of the pump cartridge 100 from the pumping system 10 is facilitated by the electrical connections to the pump motor 150. Referring again to FIGS. 3, 4, 9A, and 9D, the pump cartridge 100 is further comprised of three electrical wires 152, 154, and 156 which provide electrical power to the pump motor 150 and grounding of the pump cartridge 100. The wires 152, 154, and 156 are connected to a 3-pin electrical connector 158, which is connected to a corresponding mating electrical connector 62. The mating electrical connector 62 is connected to the level switch 65 of the level switch assembly 60, and to the power cord 70. For removal and replacement of the pump cartridge 100, the electrical connectors 158 and 62 are simply joined together or unplugged. This electrical wiring arrangement is simplified and easy to connect and disconnect, as compared to conventional pump and level switch connections.

The exemplary pump cartridge 100 as shown in the drawings and described above includes a pump motor and a rotating impeller. The exemplary pump cartridge 100 is configured as a centrifugal pump. It is to be understood that a pump cartridge of the present disclosure is not limited to a centrifugal pumping configuration. The pump cartridge may have other configurations for moving fluids, including but not limited to configurations of gear pumps, vane pumps, progressing cavity pumps, piston pumps, and blowers for moving compressible and incompressible fluids. The pump cartridge 100 of the present disclosure is adaptable to any configuration in which the pump cartridge 100 is reversibly rotatable between an access positions and an operating position. Moreover, the configuration of cartridge 100 is applicable to any arrangement of a motor contained in a housing that is reversibly rotatable between an access positions and an operating position as disclosed herein.

It is therefore apparent that there has been provided, in accordance with the present disclosure, a pump that is easily removed from and replaced in its working environment. The foregoing description of technology and the invention is merely exemplary in nature of the subject matter, manufacture, and use of the invention and is not intended to limit the scope, application, or uses of any specific invention claimed in this application or in such other applications as may be filed claiming priority to this application, or patents issuing therefrom. The following definitions and non-limiting guidelines must be considered in reviewing the description.

The headings in this disclosure (such as "Background" and "Summary") and sub-headings used herein are intended only for general organization of topics within the present technology, and are not intended to limit the disclosure of the present technology or any aspect thereof. In particular, subject matter disclosed in the "Background" may include novel technology and may not constitute a recitation of prior art. Subject matter disclosed in the "Summary" is not an exhaustive or complete disclosure of the entire scope of the technology or any embodiments thereof. Classification or discussion of a material within a section of this specification as having a particular utility is made for convenience, and no inference should be drawn that the material must necessarily or solely function in accordance with its classification herein when it is used in any given composition.

To the extent that other references may contain similar information in the Background herein, said statements do not constitute an admission that those references are prior art or have any relevance to the patentability of the technology disclosed herein. Any discussion in the Background is intended merely to provide a general summary of assertions.

The description and specific examples, while indicating embodiments of the technology disclosed herein, are intended for purposes of illustration only and are not intended to limit the scope of the technology. Moreover, recitation of multiple embodiments having stated features is not intended to exclude other embodiments having additional features, or other embodiments incorporating different combinations of the stated features. Specific examples are provided for illustrative purposes of how to make and use the compositions and methods of this technology and, unless explicitly stated otherwise, are not intended to be a representation that given embodiments of this technology have, or have not, been made or tested.

Unless otherwise specified, relational terms used in the present disclosure should be construed to include certain tolerances that those skilled in the art would recognize as providing equivalent functionality. By way of example, the term perpendicular is not necessarily limited to 90.00°, but also to any variation thereof that those skilled in the art would recognize as providing equivalent functionality for the purposes described for the relevant member or element. Terms such as "about" and "substantially" in the context of configuration relate generally to disposition, location, and/or configuration that is either exact or sufficiently close to the location, disposition, or configuration of the relevant element to preserve operability of the element within the invention while not materially modifying the invention. Similarly, unless specifically specified or clear from its context, numerical values should be construed to include certain tolerances that those skilled in the art would recognize as having negligible importance, as such do not materially change the operability of the invention.

Similarly, the terms "can" and "may" and their variants are intended to be non-limiting, such that recitation that an embodiment can or may comprise certain elements or features does not exclude other embodiments of the present technology that do not contain those elements or features. Unless noted otherwise, the pump disclosed herein encompasses all combinations of the disclosed features thereof, regardless of whether each possible combination of features defining an apparatus has been explicitly recited.

Having thus described the basic concept of the invention, it will be apparent to those skilled in the art that the foregoing detailed disclosure is intended to be presented by way of example only, and is not limiting. Various alterations, improvements, and modifications will occur to those skilled in the art, though not expressly stated herein. These alterations, improvements, and modifications are intended to be suggested hereby, and are within the spirit and scope of the invention. Additionally, the recited order of processing elements or sequences, or the use of numbers, letters, or other designations therefore, is not intended to limit the claimed processes to any order except as may be expressly stated in the claims.

I claim:

1. A pumping system comprising:

a) a chassis comprised of:

a pump basin comprising an interior side wall extending downwardly from an upper region to a lower region thereof;

a first tab extending inwardly from the lower region of the interior side wall;

a second tab extending inwardly from the lower region of the interior side wall and opposed to the first tab;

b) a pump cartridge comprised of:

an external housing including a lateral wall and a top wall proximate to the upper region of the interior side wall of the pump basin;

a first fin extending outwardly from a first exterior side portion of the lateral wall; and a second fin extending outwardly from a second exterior side portion of the lateral wall, the second exterior side portion of the lateral wall opposed to the first exterior side portion of the lateral wall;

wherein the first fin of the pump cartridge is reversibly engageable with the first tab of the chassis and the second fin of the pump cartridge is reversibly engageable with the second tab of the chassis.

2. The pumping system of claim 1, wherein the first and second fins extend outwardly from a distal region of the lateral wall of the pump cartridge, and the first and second tabs extend inwardly from a distal region of the interior side wall of the chassis.

3. The pumping system of claim 1, wherein the lateral wall of the external housing is cylindrical and the first and second fins extend radially outwardly from a distal region of the lateral wall of the pump cartridge, and wherein the interior side wall of the chassis is cylindrical, and the first and second tabs extend inwardly from a distal region of the interior side wall of the chassis.

4. The pumping system of claim 3, wherein the first tab is comprised of a nub extending downwardly from an inward end of the first tab, and the second tab is comprised of a nub extending downwardly from an inward end of the second tab.

5. The pumping system of claim 3, wherein the pump cartridge is further comprised of a first cylindrical flange extending radially outwardly from the lateral wall and a second cylindrical flange extending radially outwardly from the lateral wall, the first and second cylindrical flanges proximate to each other and defining a channel formed between them.

6. The pumping system of claim 5, further comprising a seal disposed in the channel and in contiguous contact with the interior side wall of the chassis.

7. The pumping system of claim 3, wherein the first fin of the pump cartridge is engaged with the first tab of the chassis and the second fin of the pump cartridge is engaged with the second tab of the chassis.

8. The pumping system of claim 7, wherein the first tab is comprised of a nub extending downwardly from an inward end of the first tab, and the second tab is comprised of a nub extending downwardly from an inward end of the second tab, and wherein the first fin of the pump cartridge is in contact with the nub of the first tab, and the second fin of the pump cartridge is in contact with the nub of the second tab.

9. The pumping system of claim 3, wherein the first fin of the pump cartridge is engaged with the second tab of the chassis and the second fin of the pump cartridge is engaged with the first tab of the chassis.

10. The pumping system of claim 1, further comprising a volute cover joined to a bottom wall of the chassis, and an impeller of the pump cartridge contained within a volute formed by the volute cover and the bottom wall of the chassis.

11. The pumping system of claim 1, wherein the chassis and pump cartridge are disposed in an external basin.

12. The pumping system of claim 11, further comprising a cover removably joined to the external basin.

13. The pumping system of claim 11, further comprising a level switch assembly disposed in the external basin.

14. The pumping system of claim 1, wherein the pump cartridge is further comprised of a channel fully surrounding the lateral wall.

15. The pumping system of claim 14, wherein the external housing of the pump cartridge includes a distal end and a proximal end, and wherein the channel is located in a plane perpendicular to the lateral wall and axially between the first fin and the proximal end of the external housing.

16. The pumping system of claim 14, wherein the lateral wall of the external housing of the pump cartridge is cylindrical, and the pump cartridge is further comprised of a first cylindrical flange extending radially outwardly from the cylindrical lateral wall and a second cylindrical flange extending radially outwardly from the cylindrical lateral wall, the first and second cylindrical flanges proximate to each other and defining the channel fully surrounding the lateral wall.

17. The pumping system of claim 16, further comprising a seal disposed in the channel and in contiguous contact with the interior side wall of the pump basin.

18. The pumping system of claim 1, wherein the first fin of the pump cartridge is comprised of a first tapered ramp at an end of the first fin, the second fin of the pump cartridge is comprised of a second tapered ramp at an end of the second fin, the first tab of the chassis is comprised of a third tapered ramp at an end of the first tab, and the second tab of the chassis is comprised of a fourth tapered ramp at an end of the second tab, and wherein the first tapered ramp of the first fin is engageable with the third tapered ramp of the first tab, and the second tapered ramp of the second fin is engageable with the fourth tapered ramp of the second tab.

19. The pumping system of claim 1, wherein the first fin of the pump cartridge is comprised of a first tapered ramp at an end of the first fin, the second fin of the pump cartridge is comprised of a second tapered ramp at an end of the second fin, the first tab of the chassis is comprised of a third tapered ramp at an end of the first tab, and the second tab of the chassis is comprised of a fourth tapered ramp at an end of the second tab, and wherein the first tapered ramp of the first fin is engageable with the fourth tapered ramp of the second tab, and the second tapered ramp of the second fin is engageable with the third tapered ramp of the first tab.

20. The pumping system of claim 1, wherein the first fin of the pump cartridge is engaged with the first tab of the chassis and the second fin of the pump cartridge is engaged with the second tab of the chassis, and wherein the engagement of the first fin of the pump cartridge with the first tab of the chassis and engagement of the second fin of the pump cartridge with the second tab of the chassis immobilizes the external housing of the pump cartridge within the chassis.

21. The pumping system of claim 1, wherein the first fin of the pump cartridge is disengaged from the first tab of the chassis and the second fin of the pump cartridge is disengaged from the second tab of the chassis.

* * * * *